United States Patent [19]

Sanchez, Jr. et al.

[11] Patent Number: 5,046,520

[45] Date of Patent: Sep. 10, 1991

[54] PORTABLE HOSE CART

[75] Inventors: Joseph J. Sanchez, Jr.; Stephen P. Whitehead, both of Elgin, Ill.

[73] Assignee: Suncast Corporation, Batavia, Ill.

[21] Appl. No.: 475,365

[22] Filed: Feb. 5, 1990

[51] Int. Cl.[5] ..... B65H 75/34

[52] U.S. Cl. ..... 137/355.27; 137/355.16; 242/86.2

[58] Field of Search ..... 242/86, 86.2; 137/355.16, 355.26, 355.27, 355.12; 248/145.6, 129

[56] References Cited

U.S. PATENT DOCUMENTS

| | | | |
|---|---|---|---|
| 1,001,383 | 8/1911 | Geer et al. . | |
| 2,608,360 | 8/1952 | Cootware | 242/86.2 |
| 2,609,231 | 9/1952 | Crawford | 242/86.2 |
| 2,918,975 | 12/1959 | Conery et al. | 242/86.2 |
| 3,139,192 | 6/1964 | Maguire | 211/135 |
| 3,144,041 | 8/1964 | Werner et al. | 137/355.12 |
| 3,522,888 | 8/1970 | Grams et al. | 211/132 |
| 4,512,361 | 4/1985 | Tisbo et al. | 242/86 |
| 4,768,546 | 9/1988 | Brusadin et al. | 242/86 |
| 4,777,976 | 10/1988 | Johnston et al. | 137/355.27 |
| 4,913,580 | 4/1990 | Whitehead | 403/326 |

FOREIGN PATENT DOCUMENTS

| | | | |
|---|---|---|---|
| 133490 | 7/1949 | Australia | 242/86.2 |

OTHER PUBLICATIONS

"A Tidy Way to Reel In Profits", Brochure, Ames Corp., Parkersburg, WV 26102.

*Primary Examiner*—A. Michael Chambers
*Attorney, Agent, or Firm*—Fitch, Even, Tabin & Flannery

[57] ABSTRACT

A portable garden hose cart for windably holding a garden hose and for use in transporting the hose between a storage location and a use location. The cart includes a frame made up of a pair of generally vertical frame sides. A reel for windably receiving the garden hose is positioned between the frame sides with the reel including a pair of reel sides and a hose support surface extending between the reel sides. The cart further includes an oulet tube carried by the reel for rotation therewith and an inlet tube mounted in one of the reel hubs so that the inlet tube does not rotate with the reel. The cart further includes a handle assembly of one-piece molded thermoplastic construction. The assembly has a first leg for connection to one of the frame sides, a second leg for connection to the other frame side and a crossbar interconnecting the legs. A handle assembly further includes a tray connected to the crossbar by a hinge with the tray being movable from an as-molded condition wherein the tray is not positioned to hold accessories, to a use condition where the tray is positioned to hold accessories.

12 Claims, 4 Drawing Sheets

PORTABLE HOSE CART

This invention relates to hose storage apparatus and, more particularly, to a portable hose cart having an integral handle assembly with a storage tray.

BACKGROUND OF THE INVENTION

Portable hose carts for convenient handling and storage of a garden hose have gained wide public acceptance. Such carts, which are chiefly made of molded plastic components, include a rotatable reel for taking up and paying out the hose, a frame including a pair of frame sides for supporting the reel, wheels at one end of the base of the frame, and a handle for tilting the frame onto the wheels so that the cart may be easily moved. For more information concerning the structure and operation of such a hose cart, reference may be made to commonly-assigned U.S. Pat. No. Re. 32,510, the teachings of which are hereby incorporated by reference.

U.S. Pat. No. 4,777,976 shows a portable hose cart including a U-shaped aluminum handle connected to the frame sides. This patent further teaches a discrete tray or storage box for holding accessories, and which is attached to the tops of the frame sides by threaded fasteners.

As these hose carts are for the general consuming public, it is desirable that the carts can be easily assembled. Commercially available hose carts typically use threaded fasteners to join major components. The use of such fasteners can be time consuming and requires the use of a simple hand tool. U.S. patent application Ser. No. 314,387, now U.S. Pat. No. 4,913,580 issued Apr. 3, 1990, the teachings of which are hereby incorporated by reference, teaches the use of a connector assembly for joining components of a hose cart. A male component of the assembly is molded with one piece of the cart, and a female component of the assembly is molded with a second piece of the cart to be joined to the first piece. These components are easily unlatched to permit disassembly of the hose cart for off-season storage. Further simplification in the manufacture and assembly of hose carts is always desired.

SUMMARY OF THE INVENTION

Among the several aspects and features of the present invention may be noted the provision of an improved portable garden hose cart. The cart has a reduced number of discrete components and is easy to assemble and to disassemble. More specifically, the cart includes a one-piece handle assembly including a tray which can be rotated from an as manufactured condition to a use condition where it is positioned to hold garden accessories. The cart is reliable in use, has long service life, and is relatively economical and easy to manufacture. Other aspects and features of this invention will be in part apparent and in part pointed out specifically in the following specification and accompanying drawings.

Briefly, the hose cart includes a frame having a pair of generally vertical frame sides each of which has a bearing with a bearing surface. A reel for receiving a garden hose is positioned between the frame sides with the reel having a pair of reel sides and a hose support surface extending between the reel sides. Each reel side has a generally horizontally extending hub with each hub being rotatably received in the corresponding bearing surface of its associated frame side. An outlet tube is carried by the reel for rotation therewith and has an end adapted for attachment to one end of the garden hose. An inlet tube is mounted in one of the hubs so that the inlet tube does not rotate with the reel, with the inlet tube and the outlet tube being in fluid communication. The cart further includes a handle assembly of one-piece molded thermoplastic construction. The handle assembly has a first leg adapted for connection to one of the frame sides, a second leg for connection to the other frame side and a crossbar interconnecting the legs. A tray is connected to the crossbar by a hinge with the tray being movable from an as-molded condition wherein the tray is not positioned to hold gardening accessories, to a use condition where the tray is positioned to hold gardening accessories.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
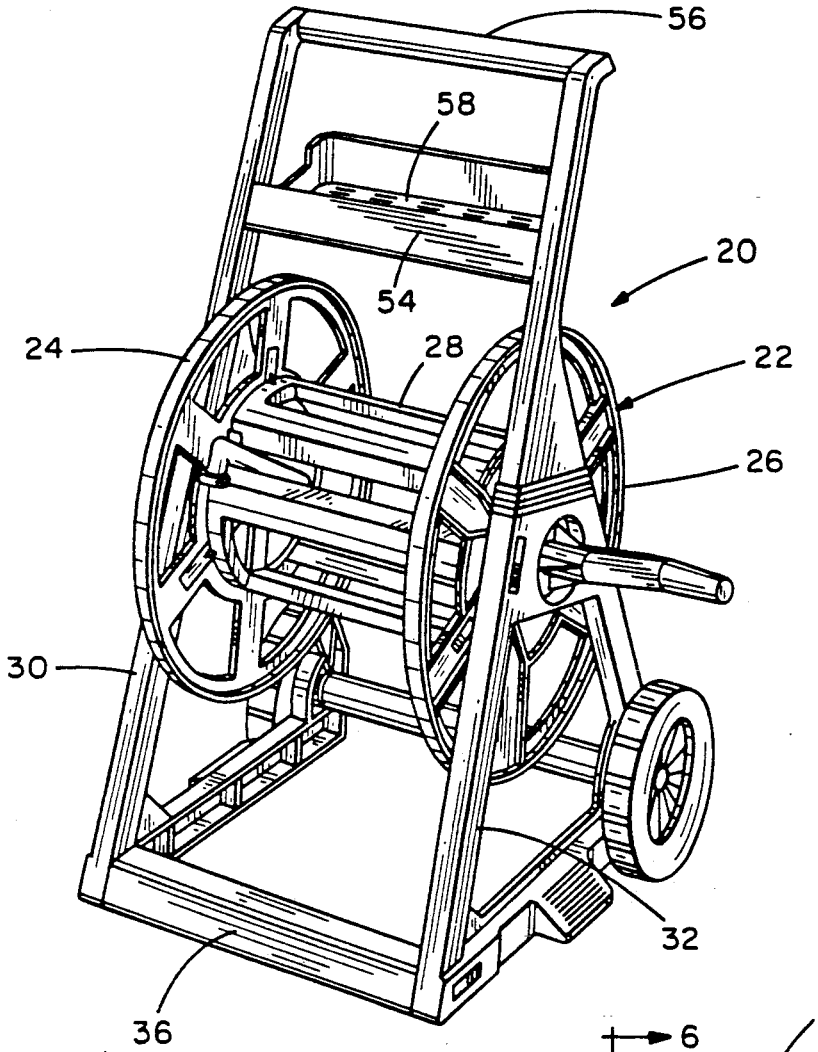
FIG. 1 is perspective view of a portable hose cart embodying various aspects of the present invention.
Figure 3:
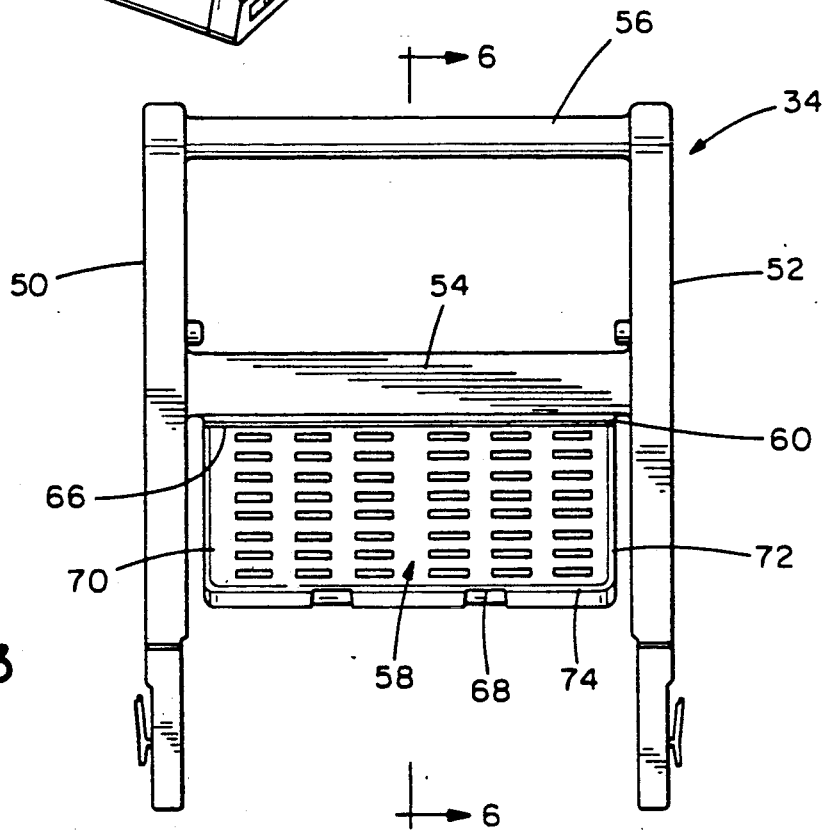
FIG. 3 is a front elevational view of a one-piece handle/tray assembly of the cart in its as-formed condition.
Figure 2:
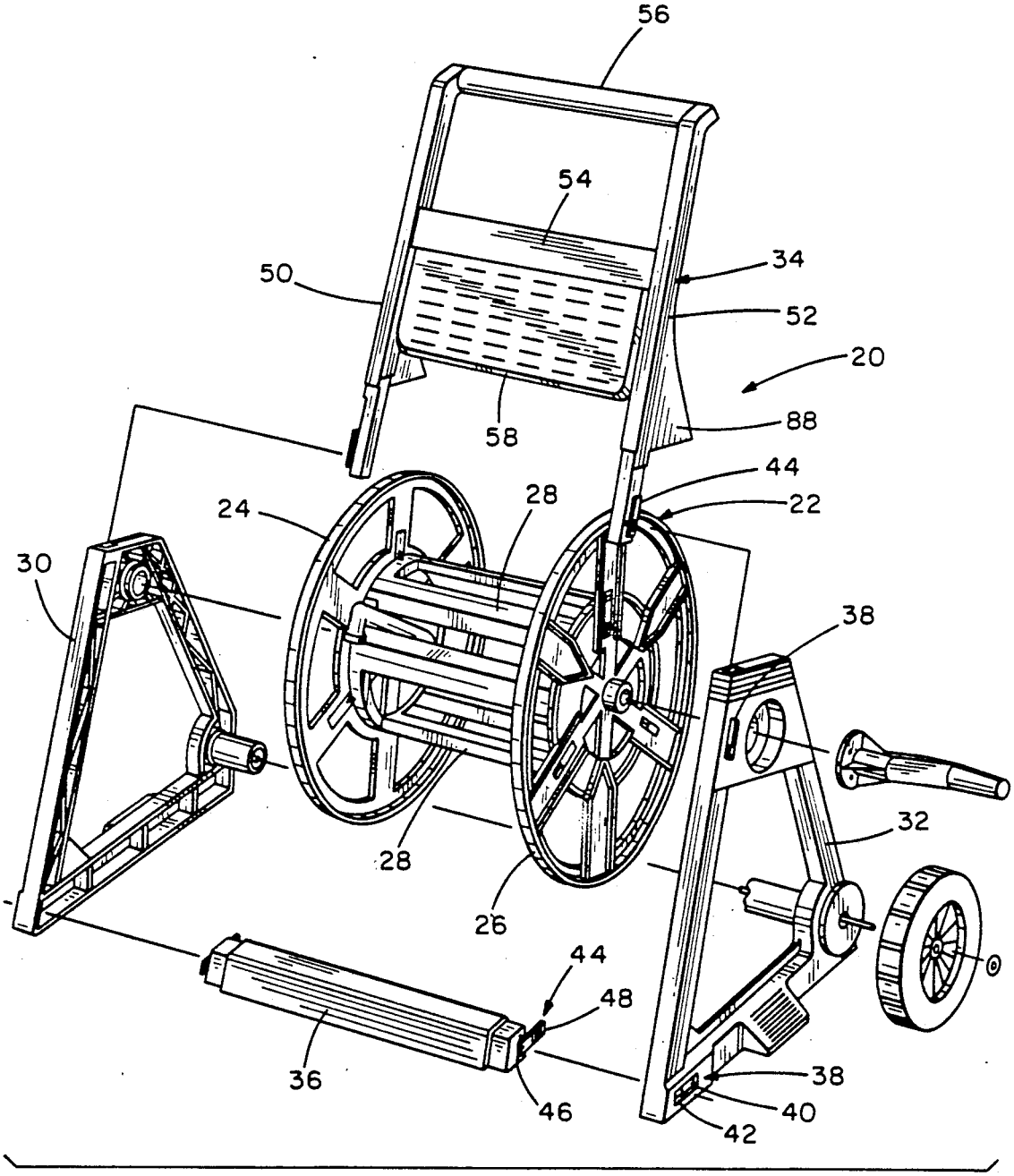
FIG. 2, similar to FIG. 1, is an exploded view of the hose cart structural components.
Figure 5:
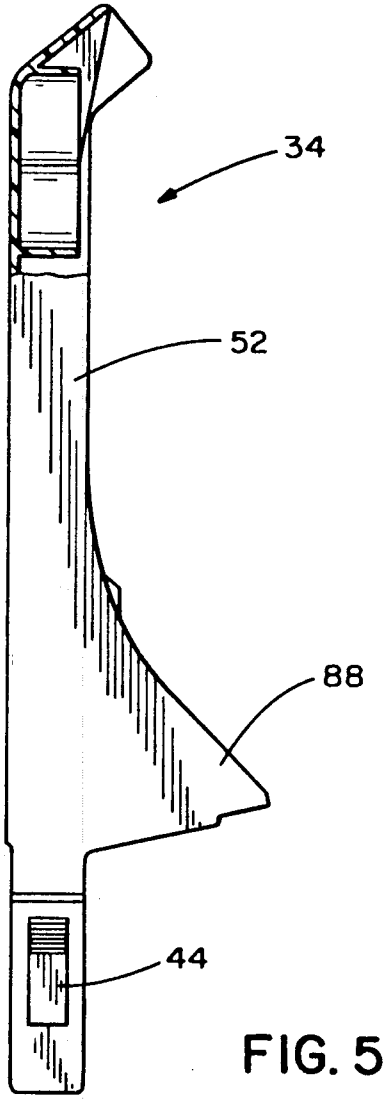
FIG. 5 is an enlarged side elevational view of the assembly.
Figure 4:
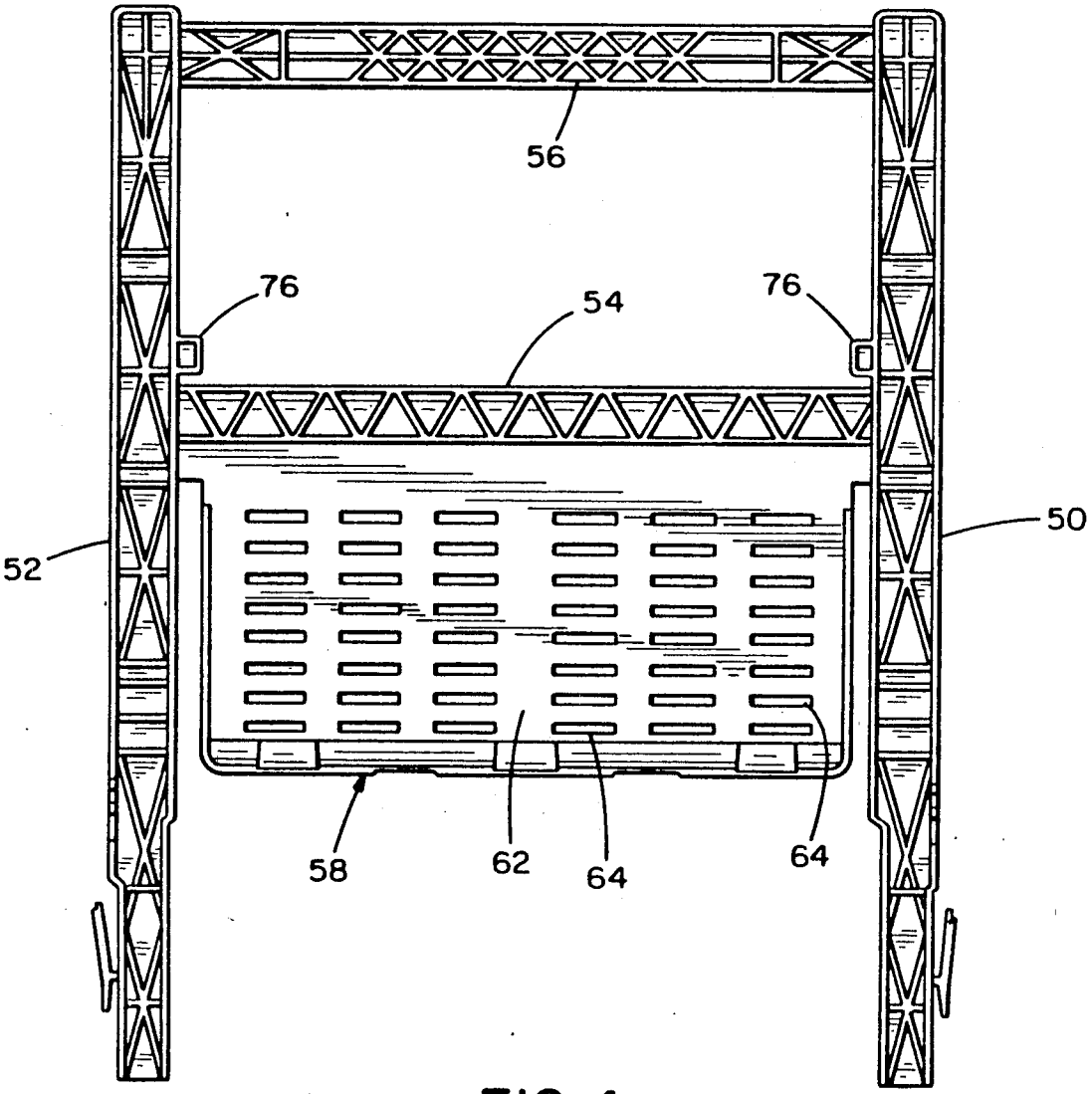
FIG. 4 is an enlarged rear elevation of the handle/tray assembly of FIG. 3.

Referring now to the drawings, a portable hose cart embodying various features of the present invention is generally indicated in FIGS. 1 and 2 by reference character 20. The cart 20 includes a reel 22 including a pair of spaced reel flanges 24, 26 joined by a spool 28 upon the outer surface of which is wound a garden hose. The cart also includes a pair of generally vertical sides 30, 32 rotatably holding the reel 22, a handle assembly 34, and a forward reinforcing bar 36. The sides and bar are preferably of one-piece construction and molded of a thermoplastic material such as polyethylene. The handle assembly 34 is also of one-piece molded thermoplastic construction, and is preferably formed of polypropylene as will be discussed hereinafter. Other components of the cart are discussed in U.S. Pat. Nos. Re. 32,510 and 4,777,976.

Major structural components of the cart such as the sides, handle assembly, and reinforcing bar are joined using releasably connector assemblies of the type taught by commonly-assigned, allowed U.S. patent application Ser. No. 314,387, now U.S. Pat. No. 4,193,580, issued on Apr. 3, 1990, the teachings of which have been incorporated herein by reference. Such a connector assembly includes a female component 38 carried, for example, by the base of frame side 32 and including a window 40 having a first end and a second end, an outside surface and an inside surface, a cam wall 42 disposed adjacent the first end and recessed with respect to the outside surface, and deflection means positioned adjacent the second end and the inside surface. The cam wall includes a ramp surface converging with the outside surface away from the second end.

The connector assembly also includes a male connector component 44 carried, for example, by an end of the reinforcing bar 36. The male connector component includes a male member for reception in the window 40 and a stem joining the male member to the reinforcing bar. The male member is somewhat resilient and has a head 46 with and undersurface for riding on the ramp surface and a tail 48 extending rearwardly of the head. Insertion of the head 46 into the window 40 and movement of the head on the cam wall 42 toward the window first end causes the deflection means to deflect the tail until the tail moves into the window. At that time the tail moves toward the outside surface of the female component 38 to retain the male member in the window thereby joining the frame side and the reinforcing bar. The components are released by pushing the deflectable latching tail 48 out of the window 40 and sliding the head 46 down the cam wall to disassemble the male and female connector components.

Figure 6:
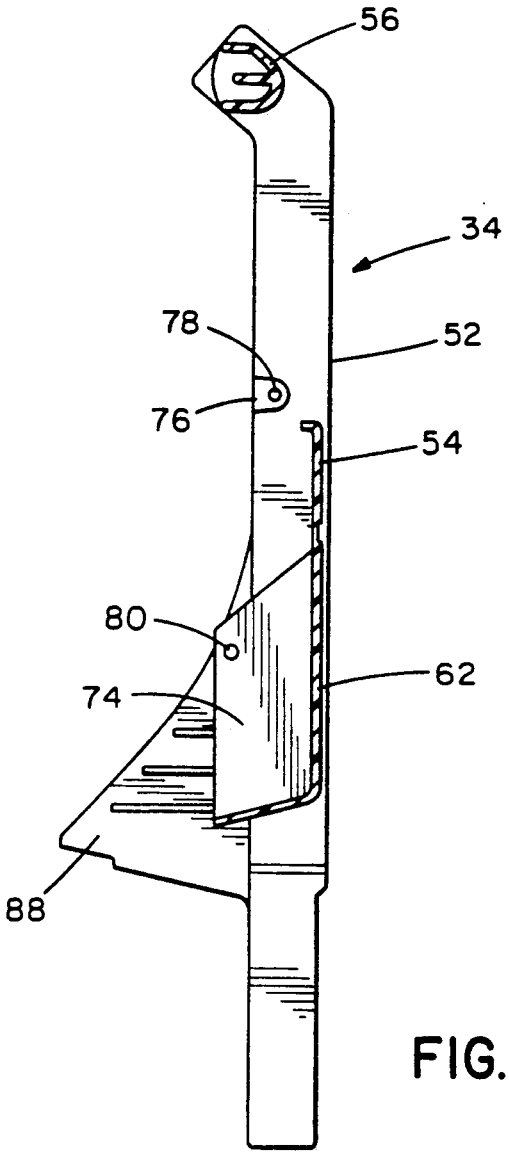
FIG. 6 is an enlarged cross-sectional view of the assembly taken generally along line 6—6 of FIG. 3.
Figure 7:
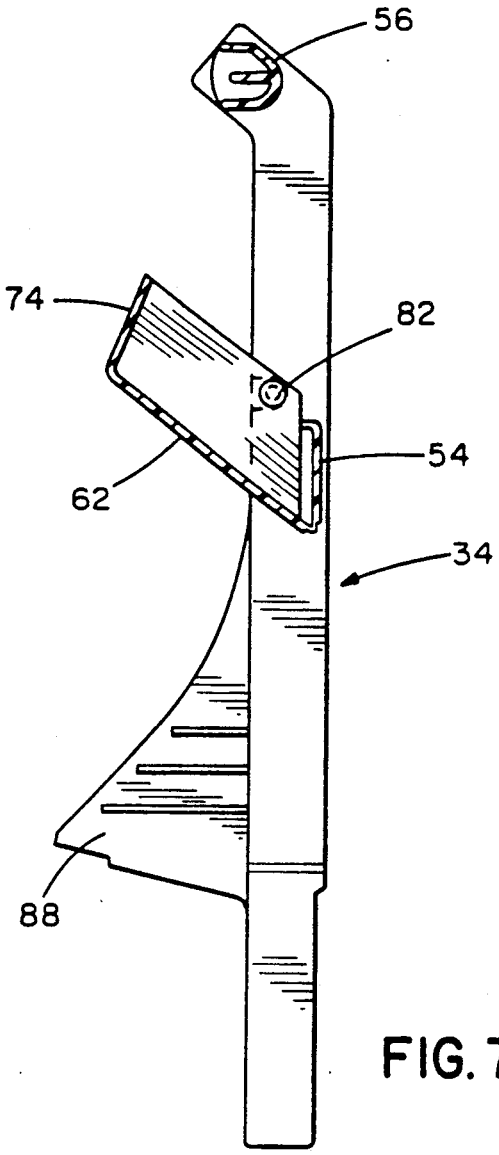
FIG. 7, similar to FIG. 6, shows the tray in its use position.

The handle assembly 34, best shown in FIGS. 3–7, includes a first leg 50 adapted for connection to frame side 30, a second leg 52 adapted for connection to frame side 32, and a crossbar 54 interconnecting the legs 50 and 52. The upper ends of the legs are inclined rearwardly with respect to the remainder of the legs, and these upper ends are joined by an upper crossbar or handle 56. The handle assembly also includes a tray 58, suitable for holding garden accessories, connected to the crossbar 54 by a hinge 60, best shown in FIG. 8. The tray 58 is movable between an as-molded condition, as shown in FIG. 6, to a use condition, as shown in FIG. 7. In the as-molded condition, the tray 58 is preferably generally disposed coplanar with the legs 50 and 52 to permit a more efficient mold configuration and to provide for ease in filling of the mold with the molten plastic.

The tray 58, which is preferably molded to depend from the crossbar 54, includes a floor 62 having an array of openings 64 to permit draining of water. The floor 62 has a proximal end 66 joined to the hinge 60, a distal end 68 and floor sides 70, 72 extending generally parallel to the legs 50, 52 and disposed somewhat inwardly of their corresponding legs. The tray 58 also includes a side wall 74 extending in the use condition of the tray upwardly along the floor sides and the distal floor end. In the use condition of the tray, the proximal end 66 of the floor 62 is blocked by the crossbar 54 so that the crossbar and the sidewall 74 cooperate to retain the accessories in the tray. It will be appreciated that because the handle assembly is made of polypropylene the tray can be moved repeatedly between its conditions without damage to the hinge 60.

The handle assembly 34 also includes means for use in retaining the tray in its use condition. More specifically, each leg 50, 52 includes an inwardly extending protuberance 76 having an aperture 78. The portions of the side wall 74 extending from the floor sides 70 and 72 are also provided with apertures 80. With the tray rotated to its use position, corresponding apertures 78 and 80 are in alignment and a fastener 82 can be inserted into the aligned apertures to retain the tray in its use position.

Figure 8:
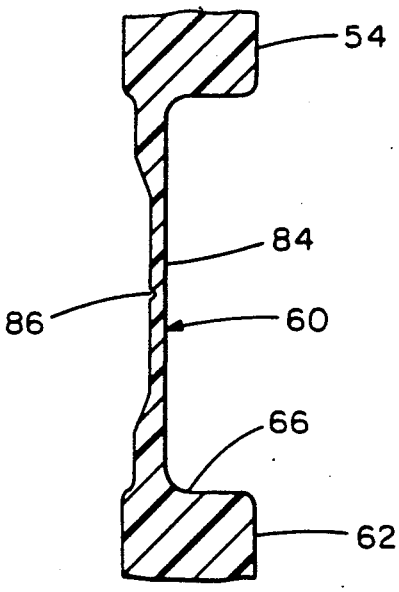
FIG. 8 is a greatly enlarged sectional view showing a hinge interconnecting the tray and the remainder of the assembly.

The hinge 60 is best shown in FIG. 8 and includes a central portion 84 of reduced cross section with a central V-shaped groove 86 to localize bending. The lower end of each leg of the handle assembly 34 is provided on its outside surface with one of the male connector components 44. As shown in FIG. 2, the upper end of each frame side 30, 32 includes a socket for receiving the leg lower, and the outside wall defining the socket includes a female connector component 38. Each of the handle assembly legs also includes a rear extension 88 which overlies the top of the corresponding frame side to provide a smooth transition from the frame side to the handle assembly therefore presenting a pleasing appearance.

Operation of the portable hose cart 20 of the present invention is as follows: After the major structural components, such as the sides 30 and 32 and the reinforcing bar 36 are assembled, as well as after the assembly of the reel 22 and associated components of the hose cart, the handle assembly 34 can be attached to the frame sides 30 and 32 using the male and female connector components. Thereafter, the tray 58 is moved to its use condition and retained in that condition through the use of the fasteners 82. In the use condition, the floor 62 of the tray is generally horizontal and the sidewall 74 in cooperation with the crossbar 54 functions to retain gardening accessories placed in the tray. The various major structural components can be disassembled by operating the connector assemblies as indicated above.

The molding of the tray 58 as an integral part of the handle assembly 34 reduces discrete components and results in increased stiffness and dimensional stability, due to the presence of crossbar 54. While the handle assembly 34 has been described for use as a component of a portable hose cart, it will be appreciated that the handle assembly also finds application with many types of portable apparatus.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable garden hose cart for windably holding a garden hose and for use in transporting said garden hose between a storage location and a use location, said cart comprising:

a frame including a pair of generally vertical frame sides each of which has a bearing with a bearing surface;

a reel for windably receiving said garden hose disposed between said frame sides, said reel having a pair of reel sides and a hose support surface extending between said reel sides, each reel side including a generally horizontally extending hub, each hub being rotatably received in the corresponding bearing surface of its associated frame side;

an outlet tube carried by said reel for rotation therewith and having an end adapted for attachment to one end of said garden hose;

an inlet tube mounted in one of said hubs so that said inlet tube does not rotate with said reel, and with said inlet tube and said outlet tube being in fluid communication; and a handle assembly of one-piece molded thermoplastic construction, said assembly including a first leg adapted for connection to one of said frame sides, a second leg adapted for connection to the other of said frame sides, a crossbar interconnecting said legs, and a tray connected in its entirety to said crossbar by hinge means, said tray being movable in its entirety from an as-molded condition wherein said tray is not positioned to hold accessories to a use condition wherein said tray is positioned to hold accessories.

2. A cart as set forth in claim 1 wherein said crossbar is a lower crossbar, said handle assembly also comprising an upper crossbar interconnecting said legs adjacent their top ends, said upper crossbar serving as a handle for said cart.

3. A cart as set forth in claim 1 wherein said legs are generally parallel, said tray in its as-molded condition extending generally parallel to said legs.

4. A cart as set forth in claim 3 wherein said tray is dependent from said crossbar.

5. A cart as set forth in claim 1 wherein said tray includes a floor having a proximal end joined to said hinge, a distal end, and floor sides extending generally parallel to said legs in the as-molded condition of said tray, said tray also including a side wall extending, in the use condition of said tray, upwardly along said floor sides and said distal end, said crossbar extending above the proximal end of said floor when said tray is in its use condition to retain said accessories in said tray.

6. A cart as set forth in claim 1 wherein said handle assembly is made of polypropylene.

7. A portable garden hose cart for windably holding a garden hose and for use in transporting said garden hose between a storage location and a use location, said cart comprising:

a frame including a pair of generally vertical frame sides each of which has a bearing with a bearing surface;

a reel for windably receiving said garden hose disposed between said frame sides, said reel having a pair of reel sides and a hose support surface extending between said reel sides, each reel side including a generally horizontally extending hub, each hub being rotatably received in the corresponding bearing surface of its associated frame side;

an outlet tube carried by said reel for rotation therewith and having an end adapted for attachment to one end of said garden hose;

an inlet tube mounted in one of said hubs so that said inlet tube does not rotate with said reel, and with said inlet tube and said outlet tube being in fluid communication; and a handle assembly of one-piece molded thermoplastic construction, said assembly including a first leg adapted for connection to one of said frame sides, a second leg adapted for connection to the other of said frame sides, a crossbar interconnecting said legs, and a tray connected to said crossbar by hinge means, said tray being movable from an as-molded condition wherein said tray is not positioned to hold accessories to a use condition wherein said tray is positioned to hold accessories, said handle assembly further comprising means for use in retaining said tray in said use condition.

8. A cart as set forth in claim 7 wherein said means for use in retaining comprises apertures in said tray and apertures in said legs with corresponding apertures being in alignment when said tray is in its use condition.

9. A cart as set forth in claim 8 further comprising fasteners extending into said corresponding apertures to retain said tray in its use position.

10. A handle assembly for portable apparatus including a frame adapted for connection to said handle assembly, said assembly being of one-piece molded thermoplastic construction and comprising:

a first leg adapted for connection to said frame, a second leg adapted for connection to said frame, a crossbar interconnecting said legs, and a tray connected in its entirety to said crossbar by hinge means, said tray being movable in its entirety from an as-molded condition wherein said tray is not positioned to hold accessories to a use condition wherein said tray is positioned to hold accessories, said handle assembly further comprising means for use in retaining said tray in said use condition.

11. A handle assembly as set forth in claim 10 wherein said assembly is made of polypropylene.

12. A portable garden hose cart for windably holding a garden hose and for use in transporting said garden hose between a storage location and a use location, said cart comprising:

a frame including a pair of generally vertical frame sides each of which has a bearing with a bearing surface;

a reel for windably receiving said garden hose disposed between said frame sides, said reel having a pair of reel sides and a hose support surface extending between said reel sides, each reel side including a generally horizontally extending hub, each hub being rotatably received in the corresponding bearing surface of its associated frame side;

an outlet tube carried by said reel for rotation therewith and having an end adapted for attachment to one end of said garden hose;

an inlet tube mounted in one of said hubs so that said inlet tube does not rotate with said reel, and with said inlet tube and said outlet tube being in fluid communication; and a handle assembly of one-piece molded thermoplastic construction, said assembly including a first leg adapted for connection to one of said frame sides, a second leg adapted for connection to the other of said frame sides, a crossbar interconnecting said legs, and a tray connected to said crossbar by hinge means, said tray being movable from an as-molded condition wherein said tray is not positioned to hold accessories to a use condition wherein said tray is positioned to hold accessories, said cart further comprising connector assemblies for releasably joining said legs to said frame sides, each connector assembly including:

a female connector component carried by one of said legs and said frame sides and including a window having a first end and a second end, an outside surface and an inside surface, a cam wall disposed adjacent said first end and recessed with respect to said outside surface, and deflection means disposed adjacent said second end and said inside surface, said cam wall including a ramp surface converging with said outside surface away from said second end; and a male connector component carried by the other of said legs and said frame sides and including a male member for reception in said window and a stem joining said male member and said second structural member, said male member being resilient and having a head with an undersurface for riding on said ramp surface and a tail extending rearwardly of said head, said head and tail having generally coplanar outside surfaces, insertion of said head into said window and movement of said head on said cam wall toward said window first end causing said deflection means to deflect said tail until said tail moves into said window past said deflection means at which time said tail moves toward said outside surface of said female component to retain said male member in said window thereby joining said first and second structural members.

* * * * *

UNITED STATES PATENT AND TRADEMARK OFFICE

CERTIFICATE OF CORRECTION

PATENT NO. : 5,046,520

DATED : September 10, 1991

INVENTOR(S) : Joseph J. SANCHEZ, Jr. et al.

It is certified that error appears in the above-identified patent and that said Letters Patent is hereby corrected as shown below:

Column 2, line 60, change "4,193,580" to --4,913,580--.

Signed and Sealed this

Twelfth Day of January, 1993

*Attest:*

DOUGLAS B. COMER

*Attesting Officer*

*Acting Commissioner of Patents and Trademarks*